US006460299B1

(12) United States Patent
Burrow

(10) Patent No.: US 6,460,299 B1
(45) Date of Patent: Oct. 8, 2002

(54) FLOOD PROTECTION ASSEMBLY

(76) Inventor: Linda R. Burrow, 55 W. Claiborne Sq., Chalmette, LA (US) 70043

( * ) Notice: Subject to any disclaimer, the term of this patent is extended or adjusted under 35 U.S.C. 154(b) by 0 days.

(21) Appl. No.: 09/638,708

(22) Filed: Aug. 15, 2000

(51) Int. Cl.[7] ..... E06B 7/00

(52) U.S. Cl. ..... 52/169.14; 52/4; 52/DIG. 12; 49/466

(58) Field of Search ..... 52/63, 169.14, 52/202, 243, 169.1, DIG. 12; 49/466, 463; 405/115

(56) References Cited

U.S. PATENT DOCUMENTS

| | | | | |
|---|---|---|---|---|
| 3,103,083 A | | 9/1963 | Seeger | |
| 4,136,995 A | | 1/1979 | Fish | |
| 4,321,774 A | | 3/1982 | Fish | |
| 4,375,929 A | | 3/1983 | Clark | |
| 4,425,744 A | | 1/1984 | Villarreal | |
| 4,488,386 A | | 12/1984 | Thompson | |
| 4,693,042 A | | 9/1987 | Villarreal | |
| 5,077,945 A | | 1/1992 | Koeniger | |
| 5,579,610 A | * | 12/1996 | Jackson | 52/4 |
| 5,647,176 A | * | 7/1997 | Milliken et al. | 52/63 |
| 6,032,433 A | * | 3/2000 | Hatziathanasiou | 52/742.12 |

* cited by examiner

*Primary Examiner*—Carl D. Friedman
*Assistant Examiner*—Jennifer I. Thissell
(74) *Attorney, Agent, or Firm*—Keaty Professional Law Corporation

(57) ABSTRACT

A flood prevention assembly uses a flexible plastic sheeting for positioning across the entryway of a building. A pair of plates are permanently attached on vertical door frame members, each plate defining a channel for receiving a hollow insert herein. The insert has a central opening for receiving an elongated bar of a shield assembly. The shield assembly has plastic sheeting stretched between the two elongated bars and secured to the bars by attachment panels. A plurality of tabs are secured along to the top edge of the shield; the tabs are folded over and secured to an elevated cross bar that is engaged with the bars of the shield assembly. An upper portion of the shield is attached to the elongated bars and the lower portion remains unsecured. The lower portion flares outwardly for positioning in front of the entryway. A primary water weight is filled with water and placed across the doorway, on the lower part of the shield. A pair of smaller water weights are also filled with water and placed in the comer of the entryway to prevent seepage of water through the comers of the entryway. An optional wedge is placed in the gap between the bottom of the door and the ground before positioning of the shield assembly across the door.

15 Claims, 1 Drawing Sheet

FLOOD PROTECTION ASSEMBLY

BACKGROUND OF THE INVENTION

This invention relates to a flood protection device and, more particularly to an assembly for placing in the entryways of buildings to stop high water from inundating a building.

It is a continuous struggle for residents of flood-prone areas to protect their buildings from rising water. Almost every year, report come from different areas of the world describing devastation and heavy economic losses suffered by flood victims. While the assembly of the present invention is not intended to protect buildings from floods of catastrophic proportions, this invention offers an inexpensive and easily installed assembly for protecting houses from water of 1–3 feet.

In the past, various methods have been suggested for protection of buildings from rising water. A traditional method is the use of sandbags placed around the building in an effort to divert the water flow.

Some of the non-traditional methods suggest construction of barriers or levees around buildings, which necessarily calls for a considerable expenditure of funds and labor. Other methods suggest digging of a channel around the building and positioning a roll of plastic sheeting therein. As the threat of flood approaches, the sheeting is designed to be unrolled and secured at 3 to 5 feet above the ground, that is to the elevation of expected rise in the water level. While some of these methods have been used for years, other methods have not been widely accepted by the general population.

The present invention contemplates elimination of drawbacks associated with the prior art and provision of a flood protection assembly for use in entryways to a building, such as doorways, to prevent rising waters from seeping into the house in the space between the door and the sill or between the window and the window sill.

SUMMARY OF THE INVENTION

It is, therefore, an object of the present invention to provide a flood prevention assembly for use in a building entryway.

It is another object of the present invention to provide a flood protection assembly that is inexpensive to manufactures and easy to install.

It is a further object of the present invention to provide a flood protection assembly that can be installed in minutes and can be stored in a compact manner when not in use.

These and other objects of the present invention are achieved through a provision of a flood protection assembly that is adapted for use with an entryway that has a frame with vertical frame members. The device comprises a pair of frame plates fixedly attachable to the frame casing vertical members, a pair of channel-forming inserts slidably engageable with the frame plates and a shield assembly that is removably positionable in front of the entryway, stretching across the entryway and rising to 1–3 feet from the ground.

The shield assembly has a pair of cylindrical bars, each of the bars slidably fitting into the channel formed by the insert members. A flexible resilient shield is secured to the bars by connecting triangular strips that extend along the length of the bars and along the upper part of the shield body. A lower part of the shield body is not secured; it flares outwardly to cover at least some surface area in front of the entryway and allow more secure positioning of the shield assembly in relation to the entryway.

The shield body has a plurality of tabs attached along the upper edge thereof. The tabs are folded over a cross bar that is placed above the shield assembly and secured by snaps or other similar means to the cross bar. In this manner, the shield is more securely held in place above the ground.

To prevent rising water from lifting the lower part of the shield body, a large weight is placed on the shield in front of the entryway. The weight body is formed from two flexible resilient sheets heat sealed together along the periphery thereof. A number of channels are formed in the weight member body to allow better distribution of weight liquid throughout the weight body. When not in use, the weight body is in a collapsed state, taking up a small amount of space. When the assembly is in use, the weight body is filled with water/liquid weight and placed on the lower part of the shield.

A pair of smaller weights are provided for placing in the comers of the entryway to secure the critical area, where rising water might seep into the house. The smaller weights are also filled with water immediately prior to use. When not in use, they are stored in a collapsed state.

An optional wedge is provided for sliding under the door to close the gap between the door and the ground. The wedge is place in the gap prior to positioning of the shield assembly across the entryway.

BRIEF DESCRIPTION OF THE DRAWINGS

Reference will now be made to the drawings, wherein like parts are designated by like numerals, and wherein.

DETAIL DESCRIPTION OF THE PREFERRED EMBODIMENT

Figure 1:
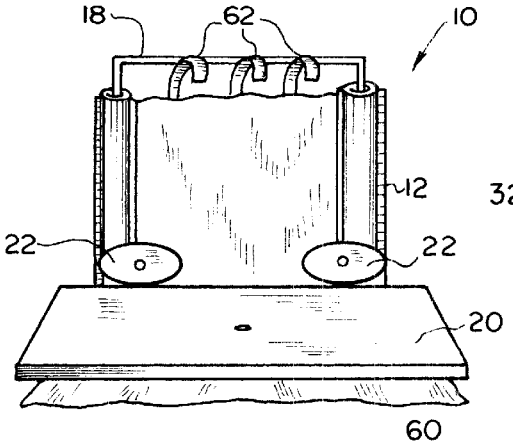
FIG. 1 is a perspective view of the assembly of the present invention placed in the doorway.

Referring now to the drawings in more detail, numeral 10 designates the flood prevention assembly in accordance with the present invention. The assembly comprises a pair of frame plates 12, a pair of insert members 14, a shield assembly 16, a suspension bar 18, a primary water weight member 20, and a pair of secondary water weight members 22. The assembly of the present invention may also include an optional wedge member 24, the function of which will be described in more detail hereinafter.

Each of the frame plates 12 consists of an elongated member made of rigid non-corrosive material, for example aluminum. Each plate 12 has a C-shaped cross section, as shown in more detail in FIG. 4. The frame plate 12 has a central portion 30 and a pair of L-shaped end portions 32. The main portion 30 is secured to a vertical frame member of an entryway, for example a door frame casing. The frame plate 12 may be affixed by nails or screws 34 spaced along the length of the main portion 30, as shown in more detail in FIG. 3.

Figure 3:
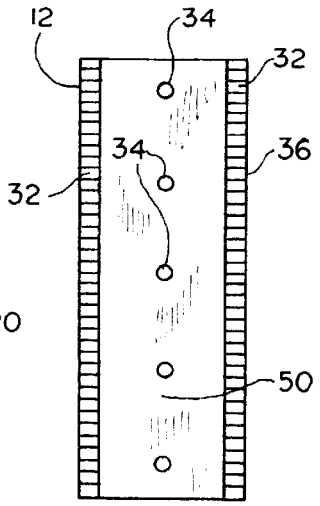
FIG. 3 is a detail front view of the frame plate.
Figure 5:
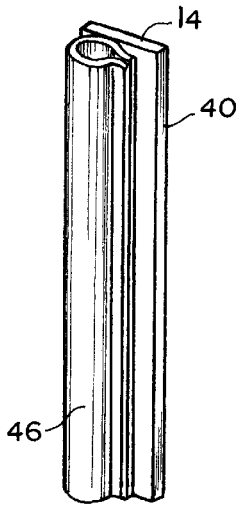
FIG. 5 is a detail perspective view of an insert member.
Figure 4:
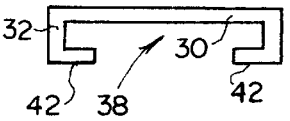
FIG. 4 is a detail enlarged top view of the frame plate.
Figure 6:
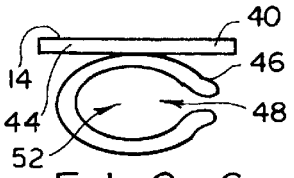
FIG. 6 is a detail enlarged top view of the insert member shown in FIG. 5.
Figure 8:
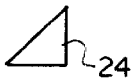
FIG. 8 is a detail end view of the wedge member to be positioned under the door.
Figure 9:
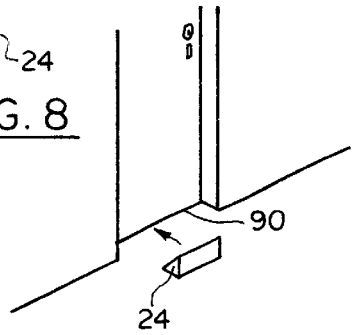
FIG. 9 is a detail schematic view showing the wedge member being inserted under the door.

Once the plate 12 is secured to the door frame casing, the space between the outer surface of the central portion 30 and the door frame casing is sealed with self-hardening waterproof adhesive, shown schematically in FIG. 3 and designated by numeral 36. The plates 12 remain permanently attached to the door frame casing, while other members of the assembly are detachably secured to the entryway when needed to prevent water entry into the house.

The length of the plates 12 varies depending on the expected level of water in that particular area. For example, where the flood waters are not expected to exceed several inches, the plates 12 maybe in the order of 14 inches. For higher levels of water, it is expected that the length of the plates may be 36–38 inches.

Each of the insert members 14 slidably fits into a channel 38 formed by the opposing inwardly facing portions 32 of the plate 12. Each insert member 14 comprises an elongated generally rectangular strip, or cross member 40 that snugly fits into the channel 38 and a flexible cylindrical portion 46. When the insert member 14 is engaged within the channel 38, inwardly turned ends 42 of the plate 12 engage an outer surface 44 of the rectangular cross-member 40.

The outwardly-facing portion 46 has a circular cross-section provided with a slot 48 that receives a portion of the shield assembly 16. The length of the insert member 14 is about the same as the length of the plate 12, so that when the insert 14 is positioned within the channel 38 of the plate 12, it substantially covers the outer surface 50 of the plate 12. The insert member 14 is made of a non-corrosive water impermeable, for example strong flexible plastic, light-weight metal, and the like. If desired the insert member 14 may be painted by the homeowner to match the color of the door frame and conceal the frame plate 12.

The shield assembly 16 comprises a pair of hollow cylindrical bars 50, which are sized and shaped to frictionally engage the insert portion 46. Fixedly attached to each bar 50 is a connecting member 54 that extends along the length of the bar 50 and fits into the slot 48 when the bar 50 is engaged with the insert member 14. The connecting member 54 may be triangular in cross section, as shown in FIG. 2, although other shapes are acceptable.

Stretched between the parallel connecting members 54 is a flexible, resilient water impermeable shield 56 which is wide enough to substantially cover the entryway into the building. The width of the shield 56 is preferably greater than the width of the door or other entryway wherein the assembly 10 is positioned. Of course, the width of the shield 56 varies depending on the particular requirement of the user.

Figure 2:
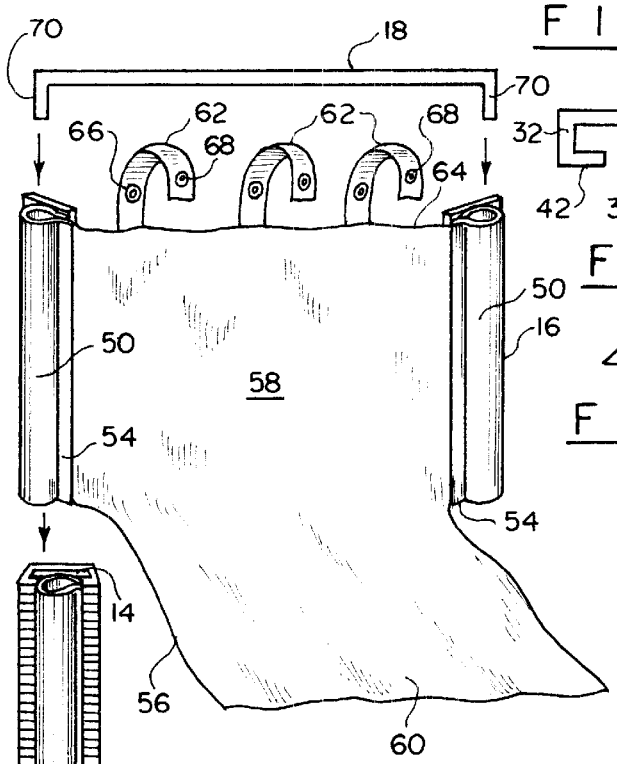
FIG. 2 is an exploded view of the assembly of the present invention.

The length of the shield 16 exceeds the length of the bars 50 and the connecting members 54, as can be better seen in FIG. 2. An upper, attached portion 58 of the shield 56 is adapted to extended vertically in parallel to the plane of the door or window. The lower, unattached portion 60 of the shield 56 is adapted to lie flat in front of the entryway and cover at least some area in front of the building door. The body of the shield 56 is made of strong, flexible resilient material that is water impermeable and strong enough to withstand the pressure and weight of water at the entryway.

The length of the shield 56 can differ from 42 inches to 66 inches depending on the length of the bars 50 and the intended height to which the sheeting needs to extend. It is envisioned that the typical width of the shield 56 would be in the order of 38–44 inches. It is also envisioned that the lower part 60 of the shield 56 can be made flared, so as to allow the user to cover greater surface area in front of the entryway and seal crevices and openings around the door frame.

A plurality of flexible securing tabs 62 is secured at the top edge 64 of the shield 56. Each tab 62 has a pair of snaps 66 and 68 that are secured together after the tabs 62 have been folded over the cross bar 18, as shown in FIG. 1. The bar 18 has a pair of downwardly projecting ends 70 that fit into central openings formed in the bars 50. When the tabs are secured over the cross bar 18, the bar 18 helps to keep the upper edge 64 of the shield 56 at the desired level above the ground.

The primary water weight 20 is a hollow body made of flexible resilient material, such as thick plastic sheeting or other rubber-like material. The water weight 20 is divided into a plurality of separate peripheral channels 74, 76, 78, and 80. The channels 74–80 are formed by heat welding of two panels that form the body of the weight member 20. A plug 82 is positioned in the center of the primary water weight 20 to allow water or other liquid weight to be poured into the water weight 20 immediately prior to the use of the assembly 10. The plug 82 maybe a screw-type plug that can be easily engaged and disengaged from the body 20.

Figure 7:
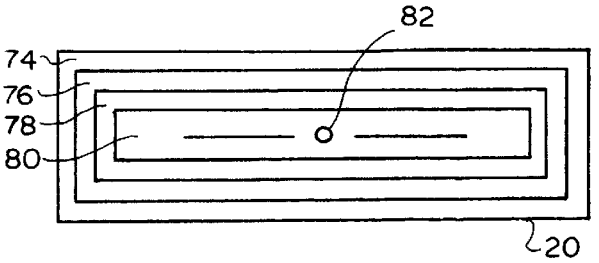
FIG. 7 is a detail top view of the primary water weight to be placed in front of the entryway.
Figure 1:
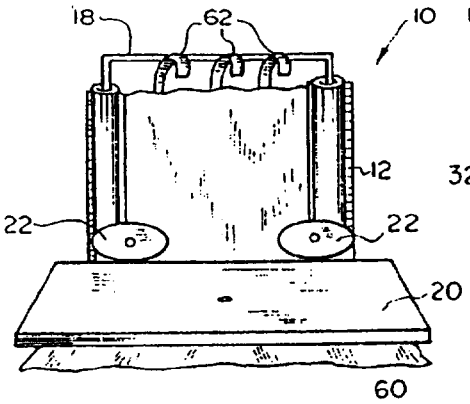
Figure 3:
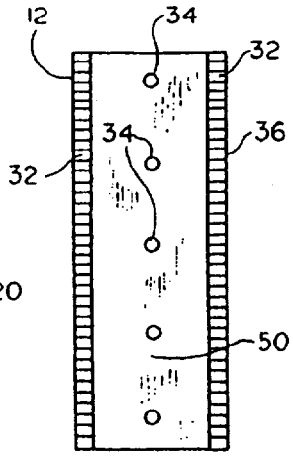
Figure 5:
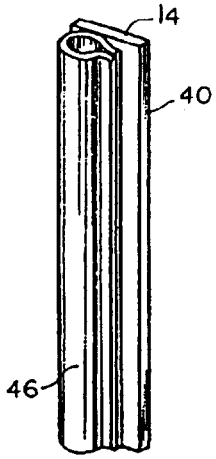
Figure 2:
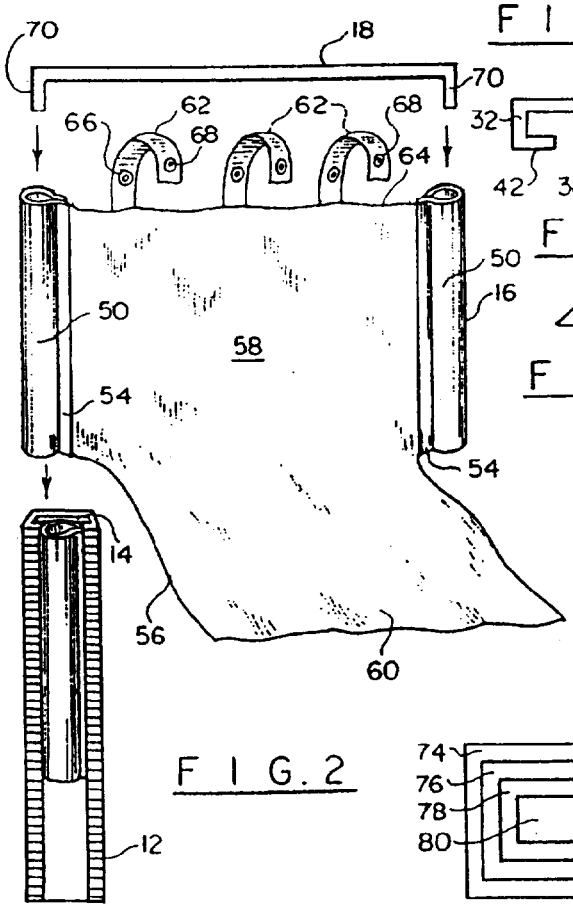
Figure 4:
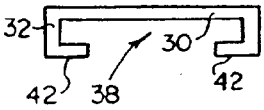
Figure 6:
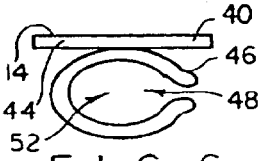
Figure 8:
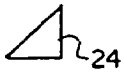
Figure 9:
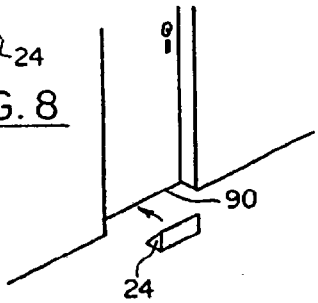
Figure 7:
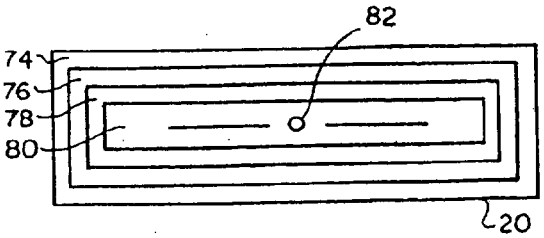
Figure 1:
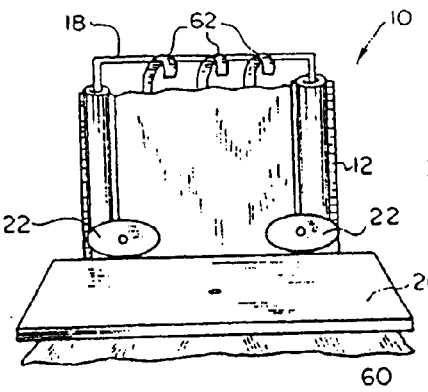
Figure 3:
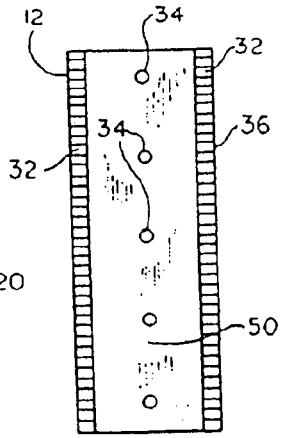
Figure 5:
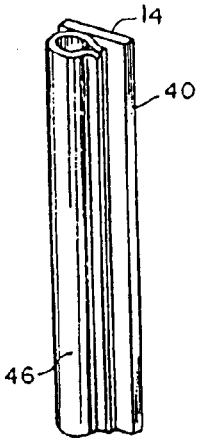
Figure 2:
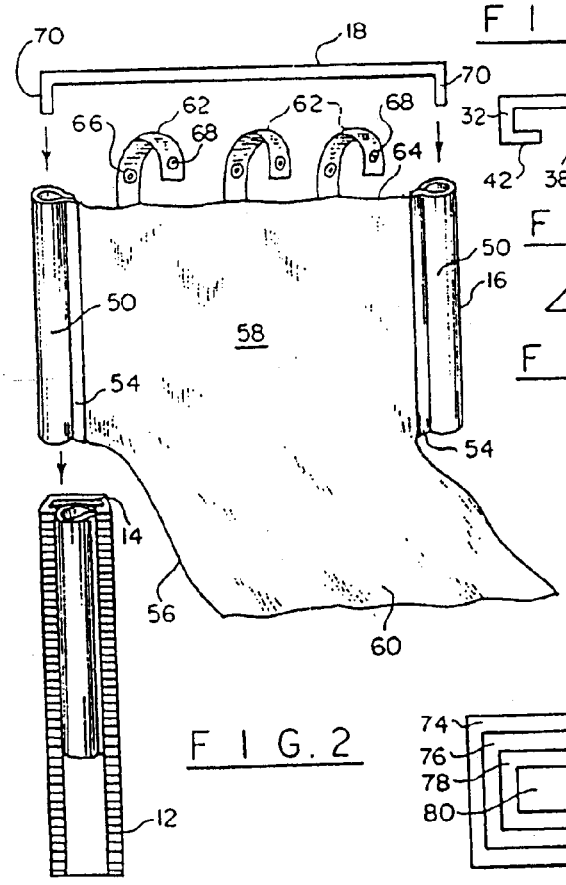
Figure 4:
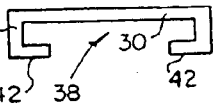
Figure 6:
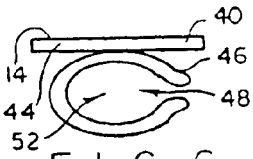
Figure 8:
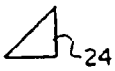
Figure 9:
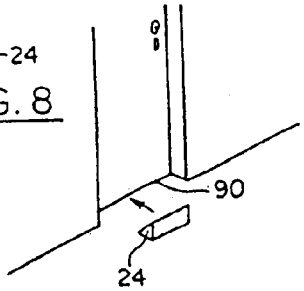
Figure 7:
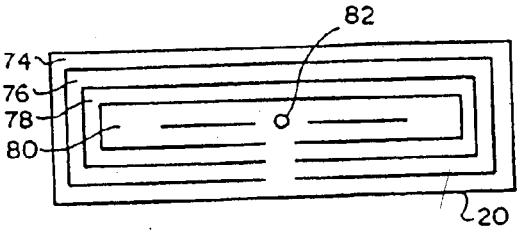

The channels 74, 76, 78, and 80 communicate with each other through openings made in the seams, as shown in FIG. 7, allowing water deposited in the water weight 20 to be more evenly distributed throughout the entire body 20. It is preferred that the body 20 is filled completely filled with water but remain relatively flexible and resilient to the touch. This allows to ensure that the water will remain distributed to keep the body 20 flat when it is positioned in front steps, walkway, or other approaches to the entryway.

Similarly, water weight members 22 are formed from the same material as the primary water weight 20. The secondary water weights 22 are smaller in size, for example an oval having a length of 12–14 inches and the width of 10–12 inches. The secondary water weights 22 are each provided with a plug 84 that allows pouring of a liquid weight, such as water into the body 22 immediately prior to its use as part of the assembly 10.

Normally, when the water is not deposited into the water weights 20 and 22, these bodies are stored in a collapsed state; they may be rolled, if necessary, and placed in a box. When filled with water, it is preferred that the water weights 22 are not filled to their full capacity to allow them to remain flexible and resilient to the touch. Similarly to the weight member 20, this feature would allow the weight members 22 to assume any required shape when placed on an uneven surface.

The secondary water weights 22 are positioned in the door comers, as shown in FIG. 1, to help keep the shield 56 in place. The primary water weight body 20 is placed over the portion 60 of the shield 56 to firmly hold down the outwardly extending edges of the plastic sheeting of the shield body 56.

An optional wedge member 24 is provided for inserting into a gap 90 under the door to close the gap 90 and to make sure that water does not penetrate into house. The wedge 24 can be a triangularly-shaped plastic bar that is placed on the ground and slipped under the door before the shield 56 is positioned in front of the door.

In operation, the plates 12 are permanently attached to the door frame casing with nails or screws 34, silicone adhesive 36 is applied to the outer edges to prevent water seepage behind the plates 12. Then, the insert members 14 are slidably engaged with frame plates 12 to cover the plates 12 and form a receiving member for the bars 50.

If desired, the insert 14 may be left permanently in place, fitted within the plates 12 for aesthetic reasons. If the insert 14 is left permanently in place, the installation of the assembly 10 becomes more efficient as the next stage, since slipping of the bars 50 into the inserts 14 requires very little time. The bars 50, being slightly flexible, slide easily into the channel 52.

Once the bars 50 are in place, the shield 56 is stretched across the door to block the water. The securing members 54 are strong enough to hold the sheeting 56 in place and prevent the sheeting 56 from being torn from the bars 50 as the weight of the water presses against the plastic sheet.

The sheeting 56, being flexible and resilient, stretches across the door and fits into recesses of the doorframe to prevent water from reaching under the door. Since the sheeting is slightly wider than the doorframe, it can withstand the water pressure against the door itself.

Once the bars 50 are inserted into the channel 52, the cross bar 18 is placed over the shield assembly 16 and the tabs 62 are wrapped over the bar 18. The snaps 66 and 68 are engaged to keep the shield 56 elevated to a desired level. As the floodwater rises, it puts additional weight on the shield 56 itself. The tabs 62 hold the shield in a correct upright position at the required height and prevent sagging of the shield 56 under the water weight.

Once the shield assembly 16 is in place, water is poured into the water weights 20 and 22, filling them almost to fall capacity. The primary water weight 20 is placed across the doorway to hold the portion 60 of the shield 56 in place under the force of water. The smaller secondary water weights 22 prevent water seepage at the inside comers of the door. The wedge 24, if desired, is positioned into the gap 90 before sheeting 56 is placed in front of the door.

An optional reminder tag may be provided for placing on the interior door knob to remind the occupants of the building that the flood protection assembly 10 is placed across the door.

Once the danger of the flood has passed, the water weights 20 and 22 are emptied of water, the bars 50 are disengaged from the inserts 14 and the plates 12, while the tabs 62 are disengaged from the bar 18. The assembly 16 and the empty water weights are then stored at a convenient location until such time as they are needed again.

The cross brace 18, if desired, can be made of an oval plastic tubing and consists of two telescopically engageable parts. The cross bar 18 can then be extended to fit any door opening, for example 32 inches, or more when necessary.

Many changes and modifications can be made in the design of the present invention without departing from the spirit thereof. I, therefore, pray that my rights to the present invention be limited only by the scope of the appended claims.

What is claimed is:

1. A flood protection assembly for positioning in an entryway of a building having a frame with vertical frame members, the assembly comprising:

a pair of frame plates adapted for secure attachment to opposing vertical frame members, each of said frame plates comprising a C-shaped body having an outwardly extending open channel;

a shield assembly detachably engageable with said frame plates, said shield assembly comprising a flexible resilient water-impermeable shield sized and shaped to cover at least a lower portion of the entryway;

a weight means for weighting down said shield around said entryway; and a pair of insert members, each insert member being slidably engageable within said channel of the frame plate, each of said insert members having a first portion sized and shaped to fit within said channel of the frame plate and a substantially cylindrical portion extending outwardly from said frame plate when said insert member is engaged in said frame plate, said cylindrical portion of the insert member having a C-shaped cross section defining a through opening therein, and wherein said shield assembly comprises a pair of cylindrical bars detachably slidably engageable within a corresponding opening of the cylindrical portion of the insert member, said shield having an upper portion secured to said bars and a lower unsecured portion for extending in front of the entryway, said lower portion flaring outwardly to cover an area greater than said entryway.

2. The assembly of claim 1, wherein said shield assembly further comprises a pair of connecting members fixedly attached to said bars and to said shield, said connecting members preventing tearing of said shield from said bars during the use of the assembly.

3. The assembly of claim 1, wherein said weight means comprises a primary weight member and a pair of secondary weight members, each weight member being adapted for receiving a liquid weight therein immediately prior to positioning of the weight members on said shield.

4. The assembly of claim 3, wherein said primary weight member is a hollow flexible resilient body divided into a plurality of channels for distribution of the liquid weight deposited into the hollow body and conformance of the primary weight member to contours of the surface area surrounding the entryway.

5. The assembly of claim 3, wherein each of said secondary weight members comprises a hollow flexible resilient body for positioning in a comer of the entryway on said shield.

6. The assembly of claim 1, further comprising a cross bar adapted for engagement with said bars of the shield assembly, said cross bar extending across the entryway a distance above a lower edge of the entryway.

7. The assembly of claim 6, wherein said shield carries a plurality of suspension tabs secured to an upper part of the shield, each of said tabs carrying securing members, said tabs being adapted for folding over said cross bar and securing to said cross bar.

8. The device of claim 1, further comprising a water wedge for positioning between a lower edge of the entryway and a horizontal surface prior to positioning of said shield assembly across the entryway.

9. A flood protection assembly for positioning in an entryway of a building having a frame with vertical frame members, the assembly comprising:

a pair of frame plates adapted for secure attachment to opposing vertical frame members, each of said frame plates comprising a C-shaped body having an outwardly extending open channel;

a pair of insert members, each insert member being slideably engageable within said channel of the frame plate, each of said insert members having a first portion sized and shaped to fit within said channel of the frame plate and a substantially cylindrical portion extending outwardly from said frame plate when said insert member is engaged in said frame plate;

a shield assembly detachably engageable with said frame plates, said shield assembly comprising a pair of cylindrical bars detachably slideably engageable within a corresponding opening of the cylindrical portion of the insert member, a flexible resilient water-impermeable shield sized and shaped to cover at least a lower portion of the entryway, said shield having an upper portion secured to said bars and a lower unsecured portion for extending in front of the entryway, said lower portion flaring outwardly to cover an area greater than said entryway; and a weight means for weighting down said shield around said entryway.

10. The assembly of claim 9, wherein said cylindrical portion of the insert member has a C-shaped cross section defining a through opening therein.

11. The assembly of claim 9, wherein said shield assembly further comprises a pair of connecting members fixedly attached to said bars and to said shield, said connecting members preventing tearing of said shield from said bars during the use of the assembly.

12. The assembly of claim 9, wherein said weight means comprises a primary weight member and a pair of secondary weight members, each weight member being adapted for receiving a liquid weight therein immediately prior to positioning of the weight members on said shield.

13. The assembly of claim 12, wherein said primary weight member is a hollow flexible resilient body divided into a plurality of channels for distribution of the liquid weight deposited into the hollow body and conformance of the primary weight member to contours of the surface area surrounding the entryway, and wherein each of said secondary weight members comprises a hollow flexible resilient body for positioning in a comer of the entryway on said shield.

14. The assembly of claim 9, further comprising a cross bar adapted for engagement with said bars of the shield assembly, said cross bar extending across the entryway a distance above a lower edge of the entryway, and wherein said shield carries a plurality of suspension tabs secured to an upper part of the shield, each of said tabs carrying securing members, said tabs being adapted for folding over said cross bar and securing to said cross bar.

15. The device of claim 9, further comprising a water wedge for positioning between a lower edge of the entryway and a horizontal surface prior to positioning of said shield assembly across the entryway.

* * * * *

UNITED STATES PATENT AND TRADEMARK OFFICE

CERTIFICATE OF CORRECTION

PATENT NO. : 6,460,299 B1
DATED : October 8, 2002
INVENTOR(S) : Linda R. Burrow

It is certified that error appears in the above-identified patent and that said Letters Patent is hereby corrected as shown below:

The sheet of drawing should be deleted to appear as per attached drawing sheet.

Signed and Sealed this

Eighth Day of April, 2003

JAMES E. ROGAN
*Director of the United States Patent and Trademark Office*

U.S. Patent Oct. 8, 2002 6,460,299 B1

UNITED STATES PATENT AND TRADEMARK OFFICE

CERTIFICATE OF CORRECTION

PATENT NO. : 6,460,299 B1
DATED : October 8, 2002
INVENTOR(S) : Linda R. Burrow

It is certified that error appears in the above-identified patent and that said Letters Patent is hereby corrected as shown below:

Drawings,
Figure 7, three horizontal lines have been broken in the center to show a drain channel formed in the primary water weight member 20, as shown on corrected drawing attached.

Signed and Sealed this

Twenty-fourth Day of June, 2003

JAMES E. ROGAN
*Director of the United States Patent and Trademark Office*

U.S. Patent Oct. 8, 2002 6,460,299 B1